United States Patent [19]

Welbourn

[11] Patent Number: 4,487,419

[45] Date of Patent: Dec. 11, 1984

[54] PROJECTILE GAME APPARATUS

[76] Inventor: Dale K. Welbourn, 310 Bardsley St., Neola, Iowa 51559

[21] Appl. No.: 554,542

[22] Filed: Nov. 23, 1983

[51] Int. Cl.[3] ..... A63B 67/00; A63B 65/00

[52] U.S. Cl. ..... 273/343; 434/348; 434/411; 434/428

[58] Field of Search ..... 273/411, 343, 428, 56, 273/348, 426, 427, 327, 336, 337, 338, 339

[56] References Cited

U.S. PATENT DOCUMENTS

| | | | |
|---|---|---|---|
| 442,675 | 12/1890 | Wilcox | 273/327 |
| 620,460 | 2/1899 | Lake | 273/56 |
| 922,432 | 5/1909 | Jirotka | 273/327 |
| 2,076,010 | 4/1937 | String | 273/427 |
| 2,797,924 | 7/1957 | Stewart | 273/343 |
| 3,685,826 | 8/1972 | Lehman | 273/343 |
| 3,701,531 | 10/1972 | Bowers | 273/343 |
| 3,717,348 | 2/1973 | Bowers | 273/343 |
| 3,814,428 | 6/1974 | Foley | 273/343 |
| 3,934,879 | 1/1976 | Curtiss et al. | 273/427 |

*Primary Examiner*—William H. Grieb
*Attorney, Agent, or Firm*—George R. Nimmer

[57] ABSTRACT

Disclosed is an aerial projectile game apparatus for playing along a horizontal play-field provided with a plurality of uprightly extending targets of the elevated cross-bar type and arranged in a courseway wherein the targets are to be serially consecutively engaged by a bola-type projectile according to some predetermined game-plan. The elevated cross-bar of the respective targets is preferably undulate along the transversely extending length to facilitate reliable engagement by the hurled bola and to permit various scoring values. The selected game-plan quest is optionally playable by two or more competing players respectively being assigned with an indentifiably marked bola. The game-plan to be selected might be analagous to that of prior art croquent utilizing rolling-ball projectiles, but instead utilizing an aerial bola projectile and an appropriate cross-bar type target.

9 Claims, 14 Drawing Figures

FIG.1
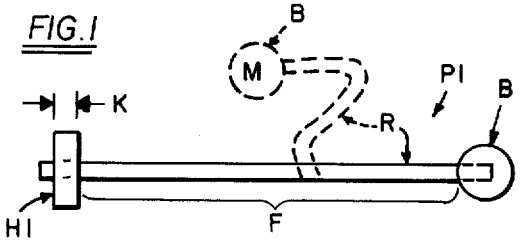
FIG.2
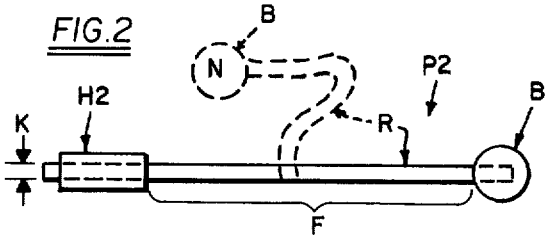
FIG.3
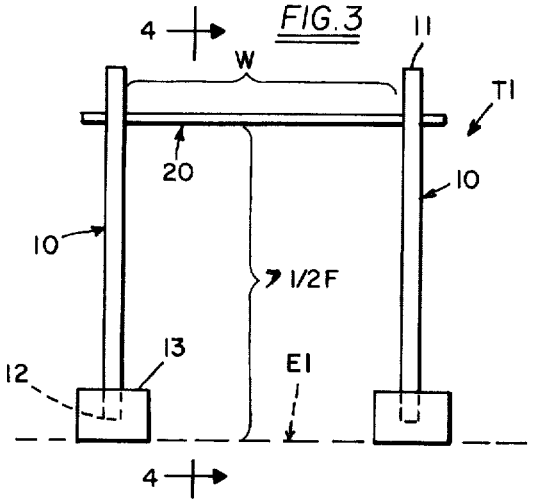
FIG.5
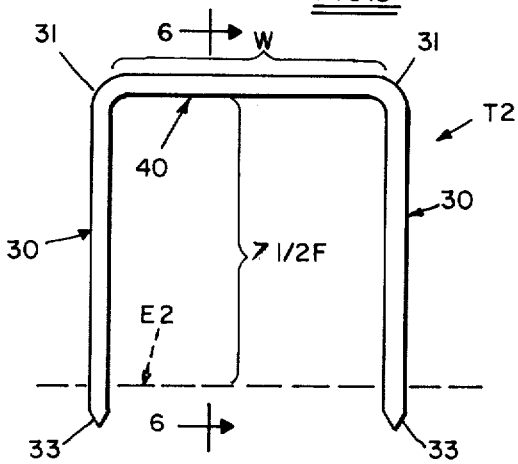
FIG.4
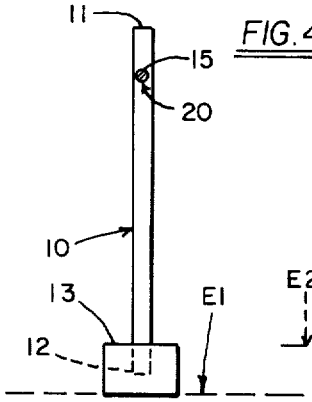
FIG.6
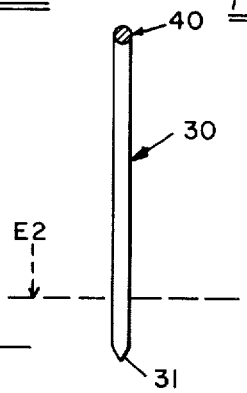
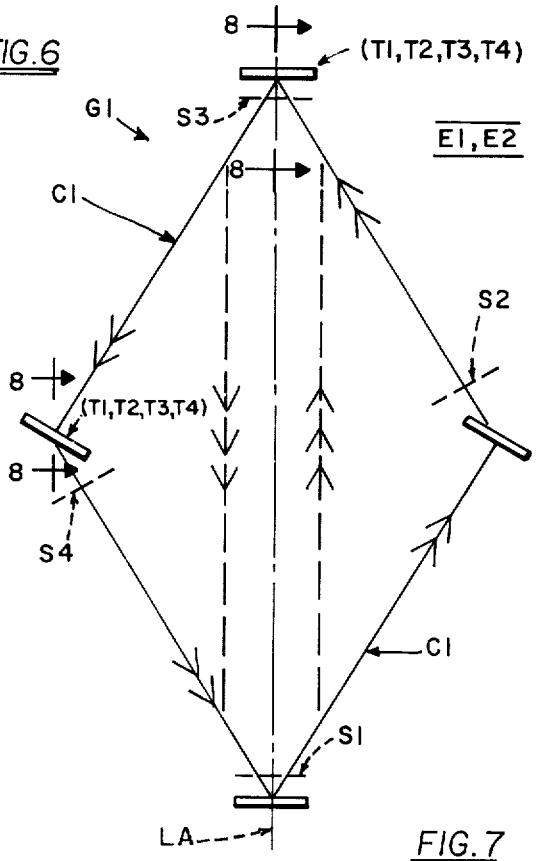
FIG.7
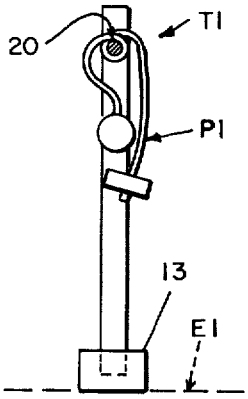
FIG.8A
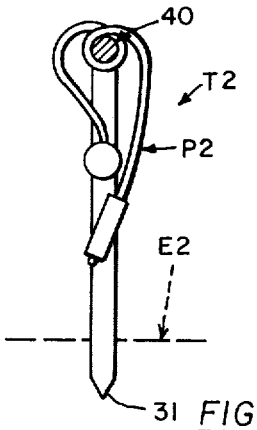
FIG.8B

PROJECTILE GAME APPARATUS

BACKGROUND OF THE INVENTION

Game apparatus utilizing elevated targets engageable by hurlable bola-type projectiles are taught by the prior art, such as in U.S. Pat. Nos. 2,797,924(Stewart-July 2, 1957) and 3,685,826(Lehman-Aug. 22, 1972). However, the prior art has encountered unresolved problems in ensuring ready reliable engagement between the hurlable bola and the target therefor and has failed to develop a sufficiently interesting and challenging game-plans for a range of possible player participants.

OBJECT OF THE INVENTION

In view of the prior art, it is the general objective of the present invention to provide a bola-type aerial projectile game apparatus wherein the upright target at the elevated cross-bar is more reliably engageable by the hurled bola and has the capability for differential scoring values, and wherein the game-plans might offer more interest and challenge than is possible with those of the prior art.

GENERAL STATEMENT OF THE INVENTION

With the above general objective in view, and together with other ancillary objectives and advantages which will become more apparent as this description proceeds, the bola-type aerial projectile game apparatus of the present invention comprises a plurality of novel cross-bar targets arrangeable in a courseway generally resembling those of prior art games such as, but not limited to, surface projectile croquet. The game apparatus includes elevated cross-bar that is preferably undulate along the confrontable length to facilitate target engagement by the hurled projectile, to permit incentive scoring values, and to readily accommodate simultaneously competing players; provides targets that might be modified for stationing on indoors flooring or on outdoors earthen play-fields; includes marking capability for the targets and/or the projectiles ancillary to accommodating a plurality of competing players; and includes plural targets courseways of optionally selectable sizes and game-plans, thereby offering interest and challenge to players of various ages and bola hurling skills.

BRIEF DESCRIPTION OF THE DRAWING

In the drawing, wherein like characters refer to like parts in the several views, and in which:

FIG. 1 is an elevational view of one form bola-type projectile which might be employed for the projectile component of a game apparatus of the present invention;

FIG. 2 is an elevational view of another form of the bola-type projectile component;

FIG. 3 is a frontal elevational view of one embodiment of a bola engageable target component of a game apparatus of the present invention;

FIG. 4 is a sectional elevational view taken along line 4—4 of FIG. 3;

FIG. 5 is a frontal elevational view of a second embodiment of the target component having particular utility for an outdoors earthen play-field;

FIG. 6 is a sectional elevational view taken along line 6—6 of FIG. 5;

FIG. 7 is a top plan view of a plurality of bola-engageable targets, such as those of FIGS. 8A and 8B, arranged in a rudimentary courseway for a representative game apparatus;

FIGS. 8A and 8B are sectional elevational views taken along lines 8—8 of FIG. 7;

DETAILED DESCRIPTION OF THE DRAWING

As previously alluded to, the aerial projectile game apparatus (e.g. "G1", "G2") generally comprises a bola type projectile (e.g. "P1", "P2", "P3") hurlable toward and engageable with the elevated horizontal cross-bar of an uprightly stationed target (e.g. "T1", "T2","T3", etc.). A plurality of such cross-bar targets are arranged in a courseway ("C1", "C2", etc.) along a horizontal play-field ("E1", "E2") and there serially consecutively engageable by the bola projectile according to a preselectable game plan, whereby the entire game apparatus is provided.

Figure 12:
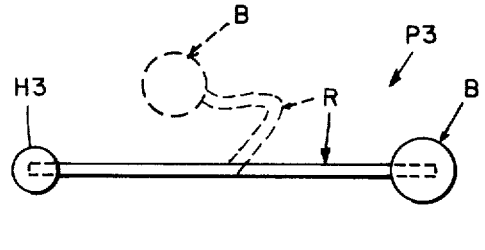
FIG. 12 is an elevational view of yet another form of the bola projectile component of the game apparatus concept.

Drawing FIGS. 1, 2, and 12, refer to representative embodiments of suitable bola type projectiles, each embodiment comprising a manually wieldable tail-weight or handle (e.g."H1", "H2", "H3") having a cross-sectional dimension of at least "K" and a centrifugal head-weight such as sphere "B" that is volumetrically larger than the tail-weight. An elongate flexible cord or rope "R" provides a tethering connection between the head-weight and tail-weight, the tether finite elongate-length "F" between the weights and typically of some twelve to eighteen inches. If two or more players are to simultaneously compete according to the selected game-plan, respective bola projectiles can be provided with player identification means assignable to the respective players such as for example markings "M", "N", etc., on the bola head-weight. In bola embodiment "P3" of FIG. 12, wieldable tail-weight "H3" is of spherical shape, whereas in embodiments "P1" and "P2" of FIGS. 1 and 2, tail-weight handles "H1" and "H2" are of cylindrical shape having finite-diameter "K". Cord "R" is coaxial with handle "H1" in embodiment "P1", but in the preferred embodiment "P2" the cord "R" is tethered intermediate the cylindrical height of handle "H2".

Basic target components as embodiments "T1" and "T2" are shown in FIGS. 3–6, target "T1" having especial utility for an indoors flooring play-field "E1", while target "T2" is penetrably stationed at an outdoors play-field "E2". Target "T1" comprises a pair of substantially parallel upright standards 10 having a finite transverse-width "W" therebetween that is typically some six to twelve inches. Each standard 10 has a lofty top-end 11 and a lower-end 12 stably stationable at the play-field, such as the attached weights 13 acting as pedestals upon a hardsurface play-field "E1". There is a transversely extending and generally horizontal cross-bar 20 connecting upper portions of standards 10, said thereby elevated cross-bar having a finite height-elevation (above the play-field) that exceeds one-half finite-length "F" of the bola cord "R". Target embodiment "T2" similarly comprises a pair of substantially parallel upright standards 30 at a said spacing "W", the standards tapered lower-ends 33 being emplantably stationable at a penetrable earthen play-field "E2". A transversely extending and generally horizontal cross-bar 40 connects upper portions (31) of standards 30; for example, entire target "T2" is providable of a single length of permanently bent structural material such as metallic rod, molded resin, etc. Accordingly, as indicated in FIGS. 8A and 8B, which are analagous to FIGS. 4 and 6, a successfully manually hurled bola projectile will wrappably engage with the appropriately elevated (>"½F") target cross-bar.

The game apparatus embodiment "G1" alluded to in FIG. 7 comprises upright targets ("T1", "T2", "T3", etc.) arranged in a rudimentary plural targets courseway extending lengthwise along a longitudinal-axis "LA" lying along a horizontal play-field ("E1", "E2"). The plural targets courseway is defined in lengthwise extent by at least two targets characterized as primary-targets (e.g. at "S1" and "S3") having their cross-bars abruptly intersecting the vertical plane of longitudinal-axis "LA". In addition to primary-targets, there is desireably a further plurality of courseway targets characterized as secondary-targets (e.g. at "S2" and at "S4") divided in membership on opposite lateral sides of longitudinal-axis "LA" and being longitudinally offset from the targets characterized as primary-targets. For the predetermined selectable game-plans, the distance between consecutively negotiated targets should exceed about ten feet and established according to the player skill level. Courseway "C1" for the FIG. 7 apparatus "G1" utilizes two primary-targets and has the provision of two secondary-targets whereby game-plans might include (though are not limited to) the following:

Game-Plan I: as indicated by double-headed solid-line arrows, proceeding in order counterclockwise: from pitching-line "S1" to a secondary-target, then from pitching-line "S2" to a primary-target, then from pitching-line "S3" to a secondary-target, and finally from pitching-line "S4" to the primary-target at "S1";

Game-Plan II: as indicated by the triple-headed phantom-line arrows, proceeding in longitudinally reciprocating fashion: from pitching-line "S1" to the longitudinally spaced primary-target; then from pitching-line "S3" to the primary-target at "S1", etc.

These and other deviseable game-plans might be followed by a solitary player or by simultaneously competing players.

Figure 10:
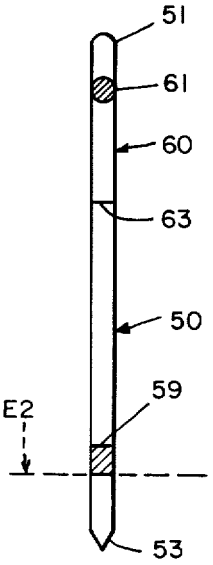
FIG. 10 is a sectional elevational view taken along line 10—10 of FIG. 9.
Figure 9:
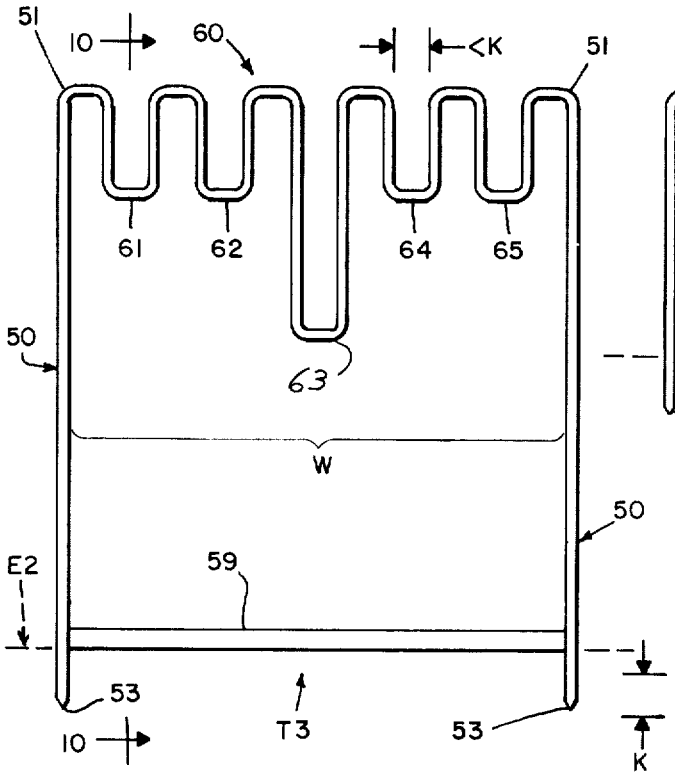
FIG. 9 is a frontal elevational view of a third embodiment of the target component.

Target embodiment "T3" of FIGS. 9 and 10 includes two structural refinements not shown in target embodiments "T1" and "T2". Embodiment "T3" includes a transversely horizontal structural member 59 connecting the two upright standards 50 nearer to tapered lower-ends 53 than to top-ends 51; thus, member 59 provides a rigid step-bar whereby the target might be trod into penetrating engagement with an earthen play-field "E2". Embodiment "T3" also includes a cross-bar 60 provided with depending undulations (61-65) along portions of its transverse-length "W" wherein the transverse width of a cross-bar undulation is preferably less than the aforedescribed "K" value. In this vein, the player might hurl the bola in a trajectory wherein its larger head-end ("B") barely clears the target cross-bar whereby the descending tail-weight ("H") becomes trapped at a depending undulation (61, etc.). Such cross-bar undulations also provide a capability for differential scoring values according to relative positioning, depth, coloration, markings, etc., for the respective undulations.

Figure 11:
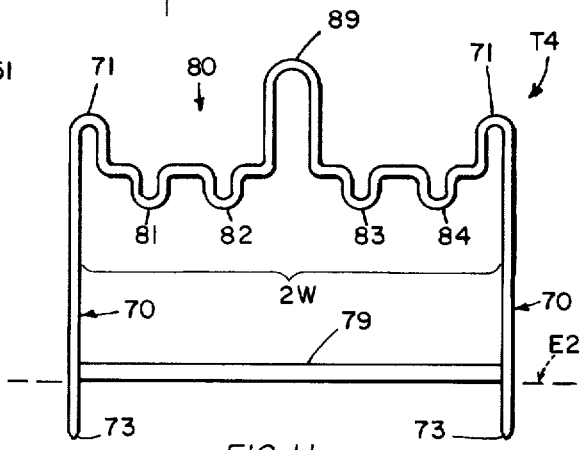
FIG. 11 is a frontal elevational view of a fourth embodiment of the target component.

Though the target embodiments "T1", "T2", and "T3" might be employed for two or more competing players, double-width ("2W") targets are more advantageous in this regard. For example, target embodiment "T4" of FIG. 11 comprises widely spaced ("2W") upright standards 70 having top-ends 71 and tapered lower-ends 73, step-bar 79, and elevated cross-bar 80 having both depressed undulations (81-84) and raised undulations (e.g. divider-undulation 89).

Figure 13:
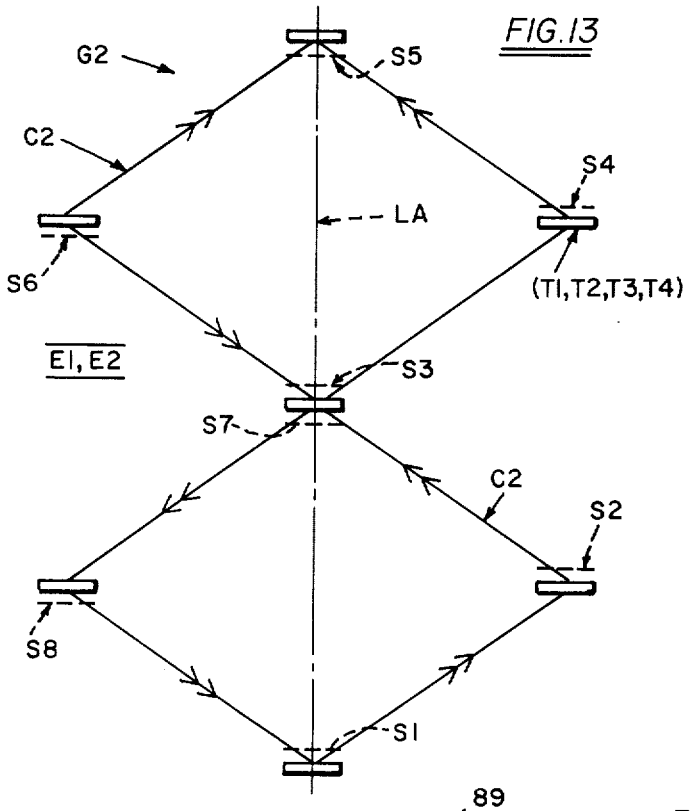
FIG. 13 is a top plan view similar to FIG. 7, but showing apparatus with targets courseway of a more sophisticated nature.

Game apparatus embodiment "G2" of FIG. 13 differs from embodiment "G1" of FIG. 7 in that numerous secondary-targets are utilized and in an arrangement of a game courseway of generally X-plan view. Specifically, the two primary-targets (at pitching-lines "S1" and "S5") and the five secondary-targets (at pitching-lines "S2", "S3", "S4", "S6", "S7") together provide a courseway resembling that of "conventional croquet" (i.e. utilizing wicket-targets, and mallets for propelling surface ball projectiles). As indicated in double-headed arrows in FIG. 13, the game-plan for courseway "C2" also resembles that of "conventional croquet" though instead utilizing cross-bar targets engageable by hurlable bola projectiles of the present invention.

From the foregoing, the construction and operation of the aerial projectile game apparatus will be readily understood and further explanation is believed to be unnecessary. However, since numerous modifications and changes will readily occur to those skilled in the art, it is not desired to limit the invention to the exact constructions shown and described, and accordingly, all suitable modifications and equivalents may be resorted to, falling within the scope of the appended claims.

I claim:

1. Projectile game apparatus for playing along a horizontal play-field and comprising: a hurlable bola-type projectile, a plurality of targets therefor respectively extending uprightly from the play-field, and a plural targets courseway wherein the targets are specially arranged to be serially consecutively engaged by the bola-type projectile according to a predetermined game plan, A. said bola-type projectile comprising a pair of weights including a volumetrically larger head-weight and a smaller tail-weight respectively tethered to an elongate flexible connector cord whereby there exists a finite elongate-length between said weights;

B. each of said targets including:

i. a pair of substantially parallel upright standards having a finite transverse-length therebetween, each standard having a lower-end stationable at the play-field, and ii. a transversely extending and generally horizontal undulated cross-bar connecting upper portions of said standards, said undulated cross-bar having a finite height-elevation above the standards at the play-field, said height-elevation exceeding about one-half said cord elongate-length; and C. said plural targets courseway extending longitudinally lengthwise along a longitudinal-axis lying along said horizontal play-field and comprising at least four targets, said courseway being defined in a lengthwise extent of at least ten feet by two said targets characterized as primary-targets having their cross-bars transversely intersecting the vertical plane of said longitudinal-axis, said courseway further including at least two additional targets characterized as secondary-targets divided in membership along opposite lateral sides of said longitudinal-axis vertical plane and thereat longitudinally offset from said two primary-targets.

2. The game apparatus of claim 1 wherein the target standards at the lower-ends are of tapered configuration to facilitate the target being emplantably stationable to an earthen play-field.

3. The game apparatus of claim 2 wherein a transversely extending and substantially horizontal step-bar connects the standards at substantially said height-elevation below the undulated cross-bar and above the standard lower-ends whereby the target might be trod into the emplanted station.

4. The game apparatus of claim 1 wherein the target upright standards and the cross-bar are together provided of a single length of permanently bent rod-like structural material.

5. The game apparatus of claim 1 having the capability for accommodating at least two players competing for the same game-plan and comprising a plurality of bola-type projectiles, respective projectiles having player identification means assignable to respective competing players.

6. The improved projectile of claim 5 wherein the player identification means is carried by said spherical head-weight for said projectile.

7. The improved projectile of claim 6 wherein said tail-weight intermediately along its cylindrical length is tethered to said cord, said tail-weight having a finite-diameter.

8. In a projectile game apparatus for playing along a horizontal play-field and comprising a plurality of targets extending uprightly therefrom, said targets being arrangeable in a play-field courseway whereby the players may proceed with projectiles to serially consecutive targets according to a predetermined game-plan, an improved target for use with an earthen play-field and bola-type projectiles, said improved target comprising:

A. a pair of substantially parallel upright standards having a finite transverse-length therebetween, each standard having a tapered lower-end for emplantation into the earthen play-field; and B. a transversely extending and generally horizontal cross-bar connecting upper portions of said standards at least a finite height-elevation above the tapered lower-ends, portions of the cross-bar transverse-length being provided with undulations whereby the bola-type projectile might be hurlably engaged with a selectable undulation of the cross-bar.

9. The improved target of claim 8 wherein a transversely extending and substantially horizontal step-bar connects the standards at substantially said height-elevation below the cross-bar and above the standards lower-ends whereby the target might be trod into uprightly emplanted station at the earthen play-field.

* * * * *